US010660429B2

(12) United States Patent
Quinn et al.

(10) Patent No.: US 10,660,429 B2
(45) Date of Patent: May 26, 2020

(54) CLEANSING SYSTEM

(71) Applicant: WATER PIK, INC., Fort Collins, CO (US)

(72) Inventors: Michael J. Quinn, Windsor, CO (US); Craig P. Rogers, Fort Collins, CO (US); Eric Summers, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 16/189,869

(22) Filed: Nov. 13, 2018

(65) Prior Publication Data

US 2019/0142147 A1 May 16, 2019

Related U.S. Application Data

(60) Provisional application No. 62/585,406, filed on Nov. 13, 2017.

(51) Int. Cl.
*A46B 5/00* (2006.01)
*A46B 11/06* (2006.01)
(Continued)

(52) U.S. Cl.
CPC ..... *A46B 5/0095* (2013.01); *A46B 7/04* (2013.01); *A46B 11/063* (2013.01);
(Continued)

(58) Field of Classification Search
CPC ..... A46B 5/0095; A46B 11/066; A46B 2200/1006; A46B 7/04; A46B 11/063; B05B 1/185
(Continued)

(56) References Cited

U.S. PATENT DOCUMENTS 2,414,653 A 1/1947 Lookholder
3,043,000 A 7/1962 Hatfield
(Continued)

FOREIGN PATENT DOCUMENTS

CN 202570479 U 12/2012
CN 102873000 A 1/2013
(Continued)

OTHER PUBLICATIONS

"Clarisonic Skin Care Device," http://www.clarisonic.com/facialcleansing-brushes/smart-profile-uplift-CL372.html; http://www.clarisonic.com/brushheads, 2017.
(Continued)

*Primary Examiner* — Huyen D Le
(74) *Attorney, Agent, or Firm* — Dorsey & Whitney LLP

(57) ABSTRACT

A handheld, therapeutic cleansing system includes a cleansing implement, for example a brush or pumice stone, magnetically coupled to a cleansing device. The cleansing device may include an elongated handle and a head portion extending from an end of the handle. The cleansing device may include a plurality of nozzles positioned around a perimeter of the head portion. The cleansing device may define an annular fluid path in fluid communication with the plurality of nozzles to supply fluid to the nozzles. The cleansing device may include a first magnetic material positioned radially inward of the annular fluid path. The cleansing implement may be magnetically coupled to the head portion of the cleansing device. The cleansing implement may include a second magnetic material that is magnetically attracted to the first magnetic material to couple the cleansing implement to the head portion of the cleansing device.

20 Claims, 11 Drawing Sheets

(51) Int. Cl.
*A46B 7/04* (2006.01)
*B05B 1/18* (2006.01)

(52) U.S. Cl.
CPC ..... *A46B 11/066* (2013.01); *A46B 2200/1006* (2013.01); *B05B 1/185* (2013.01)

(58) Field of Classification Search
USPC ..... 4/606
See application file for complete search history.

(56) References Cited

U.S. PATENT DOCUMENTS

| | | | | |
|---|---|---|---|---|
| 3,923,162 | A | 12/1975 | Hussey | |
| 4,089,079 | A | 5/1978 | Nicholson | |
| 6,123,308 | A | 9/2000 | Faisst | |
| 6,446,278 | B1 | 9/2002 | Lin | |
| 6,502,796 | B1 | 1/2003 | Wales | |
| 6,594,832 | B2 | 7/2003 | Yang | |
| 7,246,757 | B2 | 7/2007 | Juo | |
| 7,251,844 | B2 | 8/2007 | Tai et al. | |
| 7,909,061 | B2 | 3/2011 | Nelson | |
| 7,988,070 | B1 | 8/2011 | Yang et al. | |
| D651,837 | S | 1/2012 | Yang et al. | |
| 8,205,846 | B2 | 6/2012 | Glunk | |
| 8,225,946 | B2 | 7/2012 | Yang et al. | |
| 8,342,768 | B1 | 1/2013 | Johnston et al. | |
| 9,438,977 | B2 | 9/2016 | Wang et al. | |
| 9,521,898 | B2 | 12/2016 | Knight | |
| 9,560,844 | B2 | 2/2017 | Hertzog et al. | |
| 9,587,383 | B2 | 3/2017 | Wu et al. | |
| 9,643,195 | B2 | 5/2017 | Streetmaker | |
| 9,656,280 | B2 | 5/2017 | Pitsch et al. | |
| 9,683,353 | B2 | 6/2017 | Myers et al. | |
| 2003/0070998 | A1 | 4/2003 | Bulka | |
| 2004/0188577 | A1 | 9/2004 | Gaderick | |
| 2005/0125890 | A1* | 6/2005 | Zhadanov | A46B 11/063 4/615 |
| 2007/0022528 | A1 | 2/2007 | Gilbert | |
| 2008/0224011 | A1 | 9/2008 | Chang | |
| 2009/0165269 | A1 | 7/2009 | Naden et al. | |
| 2009/0308951 | A1 | 12/2009 | Suter | |
| 2013/0299608 | A1 | 11/2013 | Spangler et al. | |
| 2013/0320116 | A1 | 12/2013 | Jonte et al. | |
| 2015/0115064 | A1 | 4/2015 | Wu et al. | |
| 2015/0257533 | A1 | 9/2015 | Yang et al. | |
| 2015/0271583 | A1 | 9/2015 | Wan | |
| 2015/0345116 | A1 | 12/2015 | Chan | |
| 2016/0088927 | A1* | 3/2016 | Knight | A46B 11/066 15/4 |
| 2016/0208981 | A1 | 7/2016 | Kaesemeye | |
| 2016/0236223 | A1 | 8/2016 | Scheffer et al. | |
| 2016/0318045 | A1 | 11/2016 | Huffington et al. | |
| 2016/0325292 | A1* | 11/2016 | Hawkins | B05B 1/185 |
| 2017/0014849 | A1 | 1/2017 | Gao et al. | |
| 2017/0100727 | A1* | 4/2017 | Lin | B05B 1/1636 |
| 2017/0145671 | A1 | 5/2017 | Genord et al. | |
| 2017/0152650 | A1 | 6/2017 | Hanna et al. | |
| 2017/0191249 | A1 | 7/2017 | Chen et al. | |
| 2018/0117604 | A1* | 5/2018 | Lin | B05B 1/185 |

FOREIGN PATENT DOCUMENTS

| | | | |
|---|---|---|---|
| CN | 104874495 | A | 9/2015 |
| DE | 2543749 | A1 | 4/1977 |
| DE | 8521846 | U1 | 9/1985 |
| DE | 10008380 | A1 | 10/2000 |
| DE | 20304568 | U1 | 6/2003 |
| DE | 202004016497 | U1 | 12/2004 |
| DE | 202006017420 | U1 | 3/2007 |
| DE | 202011004062 | U1 | 8/2011 |
| DE | 202016100840 | | 6/2016 |
| EP | 0194411 | A2 | 9/1986 |
| EP | 0704580 | A2 | 4/1996 |
| EP | 2778299 | A1 | 9/2014 |
| EP | 2096215 | B1 | 4/2015 |
| FR | 2658435 | A1 | 8/1991 |
| FR | 3013366 | A1 | 5/2015 |
| GB | 2431861 | B | 7/2008 |
| GB | 2517120 | A | 2/2015 |
| JP | H0975253 | A | 3/1997 |
| JP | H1085154 | A | 4/1998 |
| JP | 2003088480 | A | 3/2003 |
| KR | 20100007297 | A | 1/2010 |
| KR | 101167115 | B1 | 7/2012 |
| NL | 1028853 | C1 | 10/2006 |
| WO | 2005058505 | A1 | 6/2005 |
| WO | 2008107102 | A1 | 9/2008 |
| WO | 2008107103 | A1 | 9/2008 |

OTHER PUBLICATIONS

"Magnetix—It's a Snap to Use." https://www.moen.com/magnetix, 2017.

"Spin Spa—Turn Every Shower Into a Luxurious Experience," https://www.spinspa.com/mid=8959634, 2017.

* cited by examiner

CLEANSING SYSTEM

CROSS-REFERENCE TO RELATED APPLICATION

This application claims the benefit of priority under 35 U.S.C. § 119(e) of the earlier filing date of U.S. Provisional Patent Application No. 62/585,406, filed 13 Nov. 2017 and entitled "Cleansing System with Accessory Storage," which is hereby incorporated by reference in its entirety.

TECHNICAL FIELD

The technology disclosed herein relates generally to cleansing systems and more specifically to skin cleansing systems.

BACKGROUND

Cleaning and exfoliating skin is a typical part of hygiene routines for many people. Recently, skin cleansing brushes and other devices have been marketed as a way to clean, stimulate, and/or exfoliate skin better than a person's hands alone. Skin brushes are typically designed for a specific purpose in a "one size fits all" manner. This is especially true with brushes integrated into shower spray handles. However, a person's skin is not homogeneous and different body parts may require different implements. For example, a brush designed for cleansing the face may not be ideal for skin found at the heel of the foot. Likewise, a pumice stone, suitable for use on feet, elbows, and knees, generally would not be used on the face. Thus, many users must bring multiple implements to their cleansing routine, and/or exit the bath/shower to retrieve alternative brushes. Therefore, there is a need for a cleansing system having interchangeable skin cleansing implements, wherein changing the cleansing implement is quick and easy.

The information included in this Background section of the specification, including any references cited herein and any description or discussion thereof, is included for technical reference purposes only and is not to be regarded subject matter by which the scope of the invention is to be bound.

SUMMARY

Disclosed herein is a cleansing system. The cleansing system may include a cleansing device and a cleansing implement. The cleansing device may include an elongated handle and a head portion extending from an end of the handle and including a plurality of nozzles positioned around a perimeter of the head portion. The head portion may define an annular fluid path in fluid communication with the plurality of nozzles to supply fluid to the nozzles and may include a first magnetic material positioned radially inward of the annular fluid path. The cleansing implement may be magnetically coupled to the head portion and may include a second magnetic material that is magnetically attracted to the first magnetic material to couple the cleansing implement to the head portion.

Also disclosed is a method of releasing a cleansing implement from a cleansing device. The method may include moving a first magnetic material within a head portion of the cleansing device to misalign the first magnetic material and a second magnetic material of the cleansing implement, and repositioning the cleansing implement away from the cleansing device.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1:
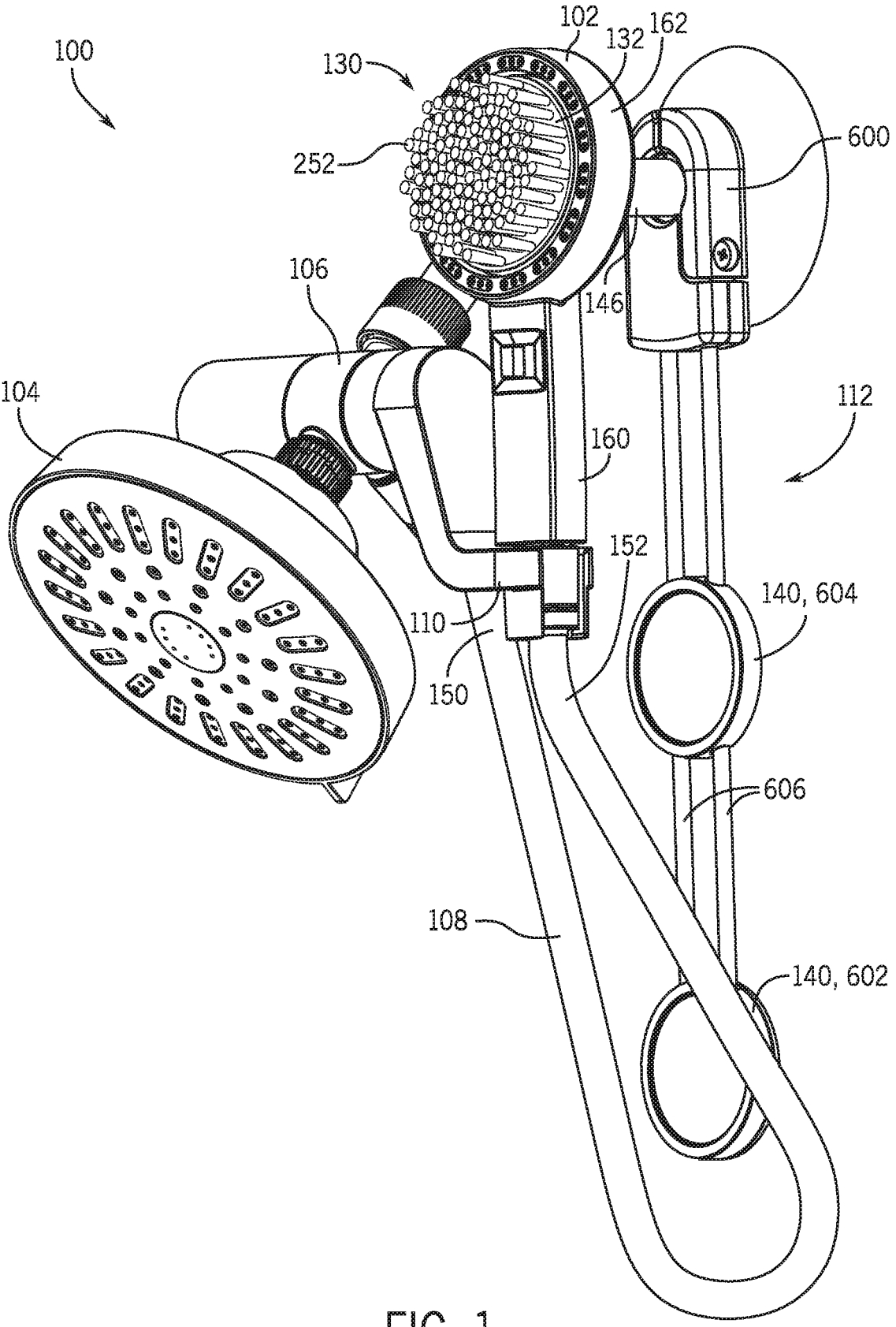
FIG. 1 is a side isometric view of a cleansing system including a showerhead, a cleansing device, and a bracket. An optional implement carrier is also pictured in FIG. 1.

A bathing or skin cleansing system is disclosed which includes a cleansing device with an integrated, removable cleansing implement or cleansing assembly that may be exchanged with one or more implements/assemblies stored on an optional implement carrier or storage system that may be positioned near the cleansing system. In one embodiment, the cleansing implement is a brush assembly that includes a bristle carrier for supporting one or more bristle groups and an engagement device for securing the assembly to the cleansing device and/or the implement carrier, each of which has a corresponding retention device that provides for securing the assembly. The retention device, or latch assembly, of the cleansing device may be manually controlled to aid in removing/replacing the assembly from the cleansing device. The latch assembly is movable relative to the cleansing device to move a retention element, such as a magnet, into and out of alignment with a corresponding retention element (such as another magnet) on the cleansing implement. For example, a user may exert a lateral force on the latch assembly, which may cause the latch assembly, or select portions of the latch assembly, to move laterally within a head portion of the cleansing device. Movement of the latch assembly causes the retention element to move out of alignment, and thus disengage, from the retention element of the cleansing implement. Then, a user can easily remove the cleansing implement from the cleansing device. The latch assembly may include a biasing element that biases the latch assembly back to its original or engaged position after the user force is removed.

In some embodiments, the engagement device of the assembly is not moveable. The implement carrier may include an attachment structure or hanger for securing the implement carrier to a water source, for example a J-pipe, or other convenient location. The implement carrier may also include one or more holders for securing the brush assembly/cleansing implement thereto.

In another embodiment, the cleansing system further includes a showerhead, diverter, and hose in fluid connection with the cleansing device. The diverter may include a diverter valve for directing fluid to the showerhead and/or the cleansing device. The cleansing device may further include a pause lever and a pause valve, the valve positioned within a cavity defined within the cleansing device, such as within a handle or grip portion. The pause valve may allow the user to temporarily stop water flow through the cleansing device, for example when the cleansing implement is exchanged or removed.

The storage system may selectively connect around a water pipe within a bathing enclosure. This provides an easily accessible storage location for multiple cleansing implements. In some embodiments, the storage system may include one or more implement holders that may be movable along a longitudinal length of a carrier. This allows a user to place the implement holders at a desired height relative to the carrier. In some instances the implement holders may include selective attachment mechanisms, such as a magnetic connection, to releasably secure the various cleansing implements or brush attachments, when not in use.

This disclosure relates to a bathing and/or skin cleansing system including a cleansing device with a replaceable cleansing implement and optionally a storage system for storing additional cleansing implements. Various cleansing implements may be used, for example a brush assembly or pumice stone assembly, among others. In one embodiment, a brush assembly may include a bristle carrier for supporting one or more bristle groups and an engagement device for securing the brush assembly to the cleansing device. In one embodiment, the retention device allows easy and reversible attachment/detachment of the cleansing implement by the user. In one embodiment, the retention device may operate magnetically, for example with a magnetic material positioned in the cleansing device and another positioned in the engagement device of the cleansing implement.

Additional aspects of the disclosed system are illustrated below with reference to the figures.

FIG. 1 illustrates a simplified schematic diagram of the cleansing system 100. With reference to FIG. 1, the cleansing system 100 may include a cleansing device 102, a showerhead 104, a diverter 106, a connector hose 108, a bracket 110, and, optionally, an implement carrier 112. As shown in FIG. 1, the showerhead 104 may be a fixed-mount showerhead. However, in other embodiments, the showerhead 104 may be other than fixed-mount, for example a handheld showerhead. The cleansing device 102, which may be referred to as a handle or a skin cleansing device, may include a removable cleansing implement 130, in this embodiment a brush assembly 132. The cleansing implement 130, which may be referred to as an implement assembly, may be stored on the implement carrier 112 at one or more cleansing implement holders 140.

The cleansing system 100 is configured to connect to a fluid source. As shown in FIG. 1, the cleansing system 100 may be fixedly attached to the fluid source at a J-pipe 146. In this embodiment, the diverter 106 is fluidly connected to the J-pipe 146, and both the showerhead 104 and the connector hose 108 are fluidly connected to the diverter 106. The connector hose 108, which may be referred to simply as a hose, is fluidly connected to the diverter 106 at a first end 150 and to the cleansing device 102 at a second end 152. The diverter 106, which may be referred to as or include a diverter valve, may aid in selectively directing fluid from the water source to the cleansing device 102 and/or the showerhead 104. In other embodiments, the diverter 106 may be located between the connector hose 108 and the cleansing device 102 and/or on the cleansing device 102 itself.

The cleansing system 100 of FIG. 1 further includes a bracket 110 that may be configured for holding the cleansing device 102. The bracket 110 may provide a convenient place to securely store the cleansing device 102 and may help to maintain the cleansing device 102 in a fixed position when the cleansing device 102 is not being grasped by a user. In some embodiments, the bracket 110 may be integrated into or fixedly attached to the diverter 106 and may aid in keeping the cleansing device 102 away from the showerhead 104. The bracket 110 may be configured to receive a handle grip or grip portion 160 (as depicted in FIG. 1), or a head portion 162 of the cleansing device 102.

Figure 2:
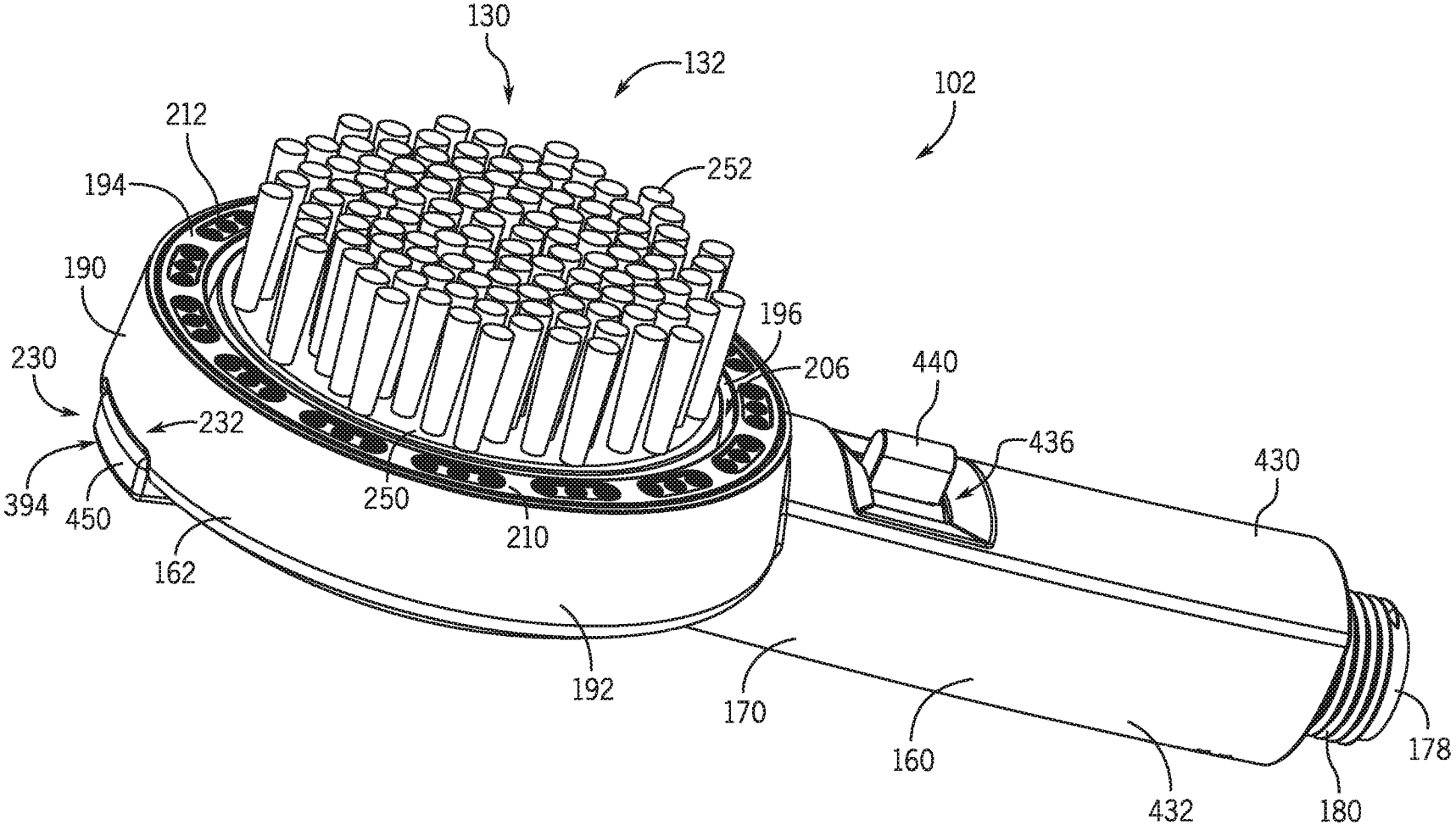
FIG. 2 is a side isometric view of the cleansing device from FIG. 1.

The skin cleansing device 102 of the cleansing system 100 will now be discussed in more detail with reference made to FIGS. 2-6. FIG. 2 shows the cleansing device 102 for the cleansing system 100 in isometric view. FIG. 2 shows one embodiment of the cleansing device 102 having a handle or handle body 170 and a brush assembly 132. In other embodiments, the cleansing device 102 may not include a brush assembly 132 or other cleansing implement 130, which may be removed from the cleansing device 102 for replacement, storage, or cleaning. The handle body 170 may define an elongated shaft, or grip portion 160, at one end and a round head portion 162 at the other. The head portion 162, which may be referred to simply as a head, may define a top of the cleansing device 102, while the grip portion 160 may define a bottom of the cleansing device 102. The head portion 162 may be formed separately from the grip portion 160 and connected thereto or may be integrally formed with the shaft of the grip portion 160 and extend therefrom. The grip portion 160, distal the head portion 162, may define a water connection end 178, that may include one or more structures 180 for securing and/or fluidly connecting the cleansing device 102 to the connector hose 108 and fluid source.

Figure 4:
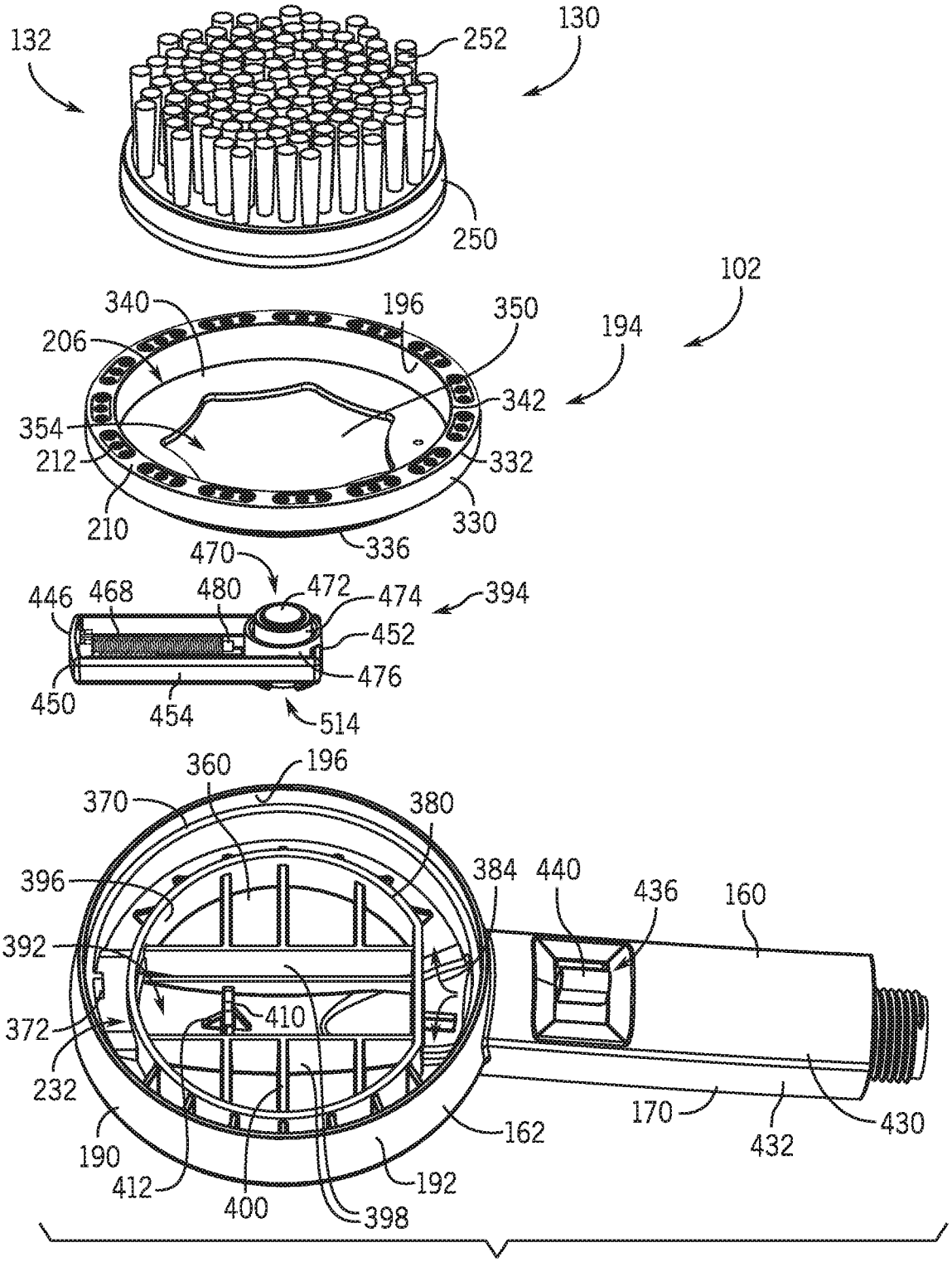
FIG. 4 is an exploded view of the cleansing device and brush assembly of FIG. 2.

With reference to FIGS. 2 and 4, the head portion 162 of the cleansing device 102 may include a head ring 190, a head ring outer wall 192, a faceplate 194, and a faceplate inner wall 196. The faceplate inner wall 196 may extend downward from the faceplate 194 to create an implement depression or cavity 206 in the faceplate 194 configured to accept the cleansing implement 130. The head portion 162 may further define a nozzle surface 210 positioned on the faceplate 194 about the implement cavity 206, the nozzle surface 210 defining a plurality of openings, or nozzles 212. The nozzles 212 can be actuated to direct fluid from the interior of the cleansing device 102 outward and generally about the brush assembly 132. In embodiments where the nozzles 212 are formed as a ring around the implement cavity 206, the nozzles 212 can direct water around the outer perimeter of the cleansing implement 130 to hit a user's body surface surrounding the contact with the cleansing implement 130, as discussed below.

The head portion 162 may also include a latch assembly 230 that may be positioned in a latch window 232 defined by the head ring outer wall 192. In other embodiments, the latch assembly 230 and latch window 232 may be positioned other than at the head apex, for example at the sides of opposite the apex, near the grip portion 160.

Subsequent figures will show the cleansing device 102 and brush assembly 132 of FIG. 2 in more detail.

Figure 3A:
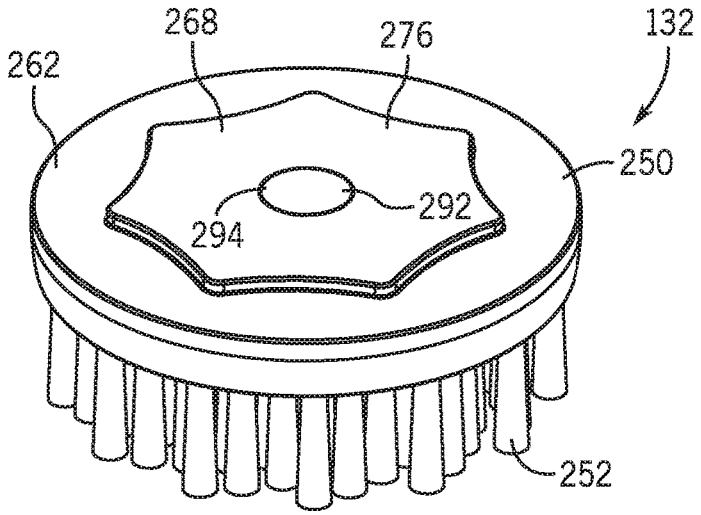
FIGS. 3A-3E provide several views of a brush assembly shown in FIG. 2.
Figure 3B:
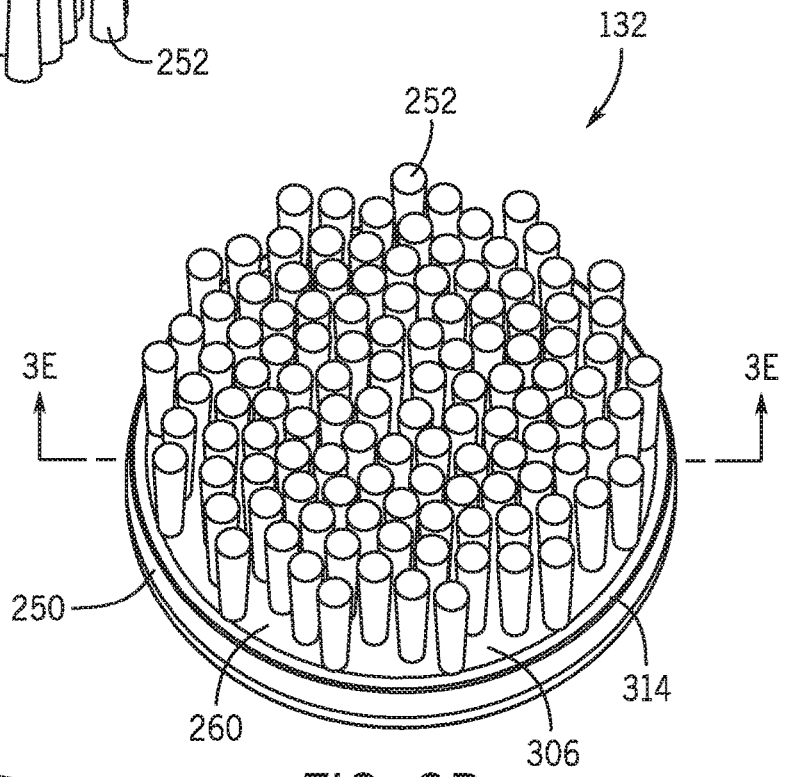

One example of a cleansing implement 130 that may be used with the cleansing device 102 is a brush assembly 132. With reference to FIGS. 3A-3E, the brush assembly 132 includes an implement base 250 and a plurality of bristles 252 coupled thereto. In one embodiment, shown in FIGS. 3A-3E, the brush assembly 132 may be a puck-like structure, where the implement base 250 includes an upper surface 260 and a lower surface 262. The lower surface 262 of the brush assembly 132 may generally define an engagement surface 268, which may be planar. In the embodiment of FIG. 3A, the engagement surface 268 extends upward and away from the lower surface 262 to define a raised engagement surface 268. In other embodiments the engagement surface 268 may extend downward and generally define a depression in the lower surface 262. In further embodiments, the engagement surface 268 and/or the lower surface 262 may be other than planar, for example concave or convex.

As described above, the engagement surface 268 defines an engagement structure 276 that may define a keyed structure. For example, in one embodiment the engagement structure 276 may include multiple prongs and curved surfaces, such as the star-shape shown in FIG. 3A having seven, rounded points. In other embodiments the engagement structure 276 may have fewer or more points, and/or may be other than star-shaped in order to define rotational stops to prevent movement of the implement base 250 during use, as discussed below.

The engagement surface 268 may also define an engagement recess 290 (see FIG. 3E) configured to receive an engagement device 292 (FIG. 3A), as discussed in more detail below. Note that in FIG. 3E, the engagement device 292 of FIG. 3A is removed from the engagement recess 290 for illustration purposes. The engagement recess 290 may be defined within a central region of the engagement surface 268 and have a thickness selected to correspond to a thickness of the engagement device 292. In other embodiments, the engagement recess 290 may be positioned in other areas of the engagement surface 268 and/or there may be multiple recesses 290 configured to receive multiple engagement devices 292 positioned around the engagement surface 268.

The engagement device 292 of FIG. 3A may be integrally formed with the engagement surface 268 or may be a separate element coupled thereto. The engagement device 292 may be various structures or devices coupled to or near the engagement surface 268. In the embodiment shown in FIG. 3A, the engagement device 292 is a magnet 294. In other embodiments, the engagement device 292 or the complementary device may be other than a magnet, for example, a magnetic material, such as iron.

In some embodiments, the engagement device 292 includes a magnetic material having a flat, planar surface positioned within the center of the engagement structure 276 and planar with the engagement surface 268. The outer surface of the engagement device 292 may be selected to have a curvature generally matching the curvature or surface features of the implement carrier 112. In other embodiments, the engagement device 292 may be positioned above or below the engagement surface 268 and/or structure. In still other embodiments, the engagement device 292 is not visible when visually inspecting the engagement surface 268.

Figure 3C:
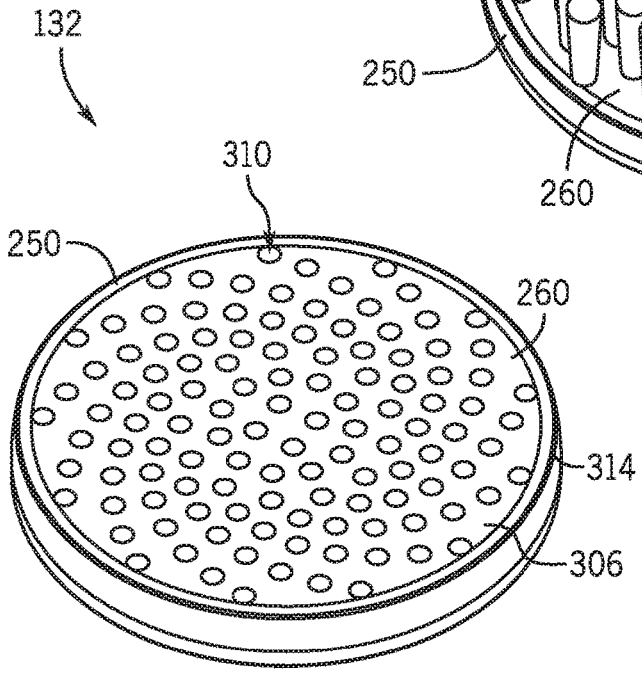
Figure 3D:
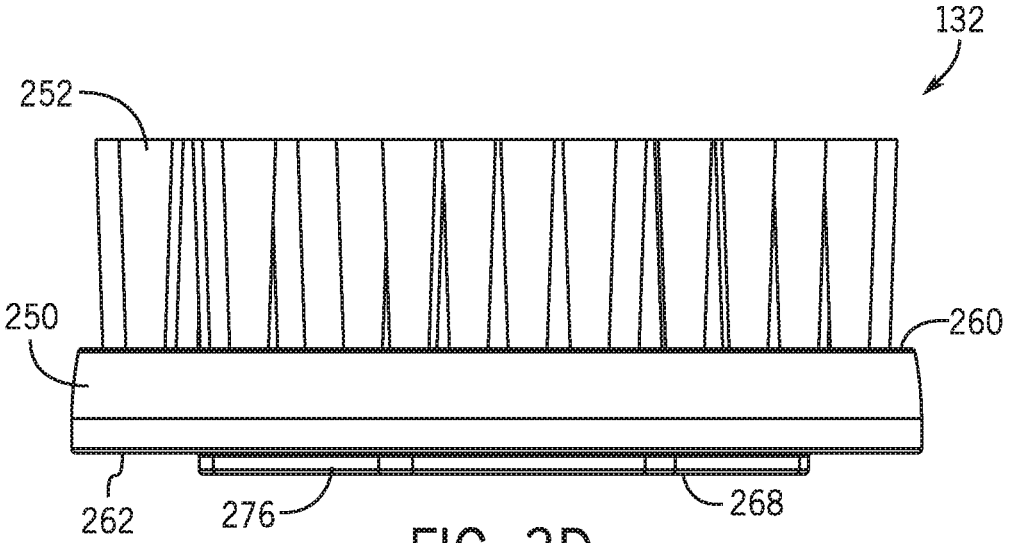
Figure 3E:
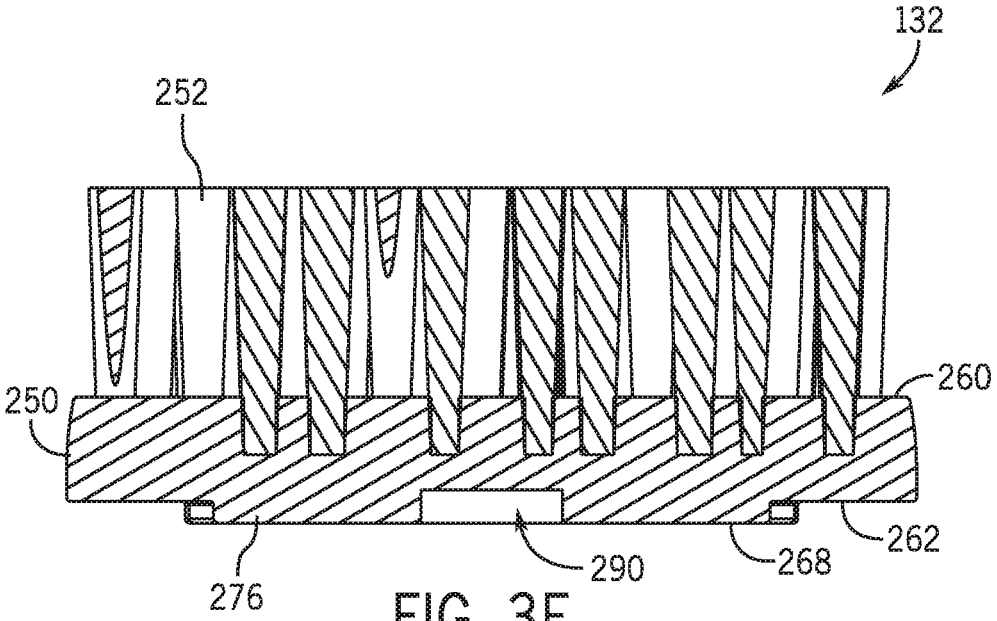

With reference to FIG. 3C, the upper surface 260 of the brush assembly 132 may act to support a plurality of bristles 252 and define a bristle surface 306. The bristle surface 306 may define a plurality of bristle cavities 310 configured to accept the bristles 252, such that one bristle 252 or a tuft of bristles 252 are positioned and secured within each bristle cavity 310. The bristle cavities 310 help to fixedly hold the bristle(s) 252 so that a portion of the bristle(s) 252 extends upward and away from the bristle surface 306. The bristles 252 may be glued or otherwise fixedly connected to the implement base 250.

The bristles 252, which may be made of various materials (e.g. plastic, rubber, metal, etc.) may be arranged in any desired manner to aid in effective cleansing and/or creating a pleasing aesthetic. In many embodiments, the plurality of bristles 252 may be deformable. In these embodiments, the deformability of an individual bristle 252 may define a mechanical stiffness. In some embodiments, the bristles 252 of a given brush assembly 132 may all possess the same mechanical stiffness. In other embodiments, the bristles 252 of a given brush assembly 132 may possess different mechanical stiffness, for example based upon their position within the bristle surface 306 or distance from a bristle surface edge 314.

FIG. 4 is an exploded view of the cleansing device 102. As shown in FIG. 4, the cleansing device 102 includes an implement base 250, a handle body 170, and a latch assembly 230 each of which is discussed, in turn, below.

The implement base 250 defines an outer face of the cleansing device 102 and couples the cleansing implements 130 thereto. The implement base 250 or faceplate 194, defines an outer wall 330 positioned at the outer edge 332 of the nozzle surface 210. The outer wall 330 of the faceplate 194 extends downward to a base 336. On the opposite side of the nozzles 212 a second, inner wall (e.g., faceplate inner wall 196) extends downward from the nozzle surface 210. This second downward-extending wall meets a floor surface 340 to define the implement cavity 206.

The implement cavity 206 is defined by the faceplate inner wall 196, which extends downward at the inner edge 342 of the faceplate 194, and the floor surface 340, positioned at the base of the faceplate inner wall 196. In this embodiment, the floor surface 340 is generally planar and includes a second, interface surface 350. As shown in FIG. 4, the interface surface 350 defines a key seat or shape corresponding to the shape of the engagement surface 268. The interface surface 350 is recessed to define a second, interface cavity 354, which is configured to accept and secure the engagement structure 276. The shape of the interface surface 350, and the shape of the interface cavity 354 it defines, are configured to prevent rotation of the brush assembly 132, and other cleansing implements 130 that may be positioned within the implement cavity 206.

The head portion 162 of the cleansing device 102 is configured to receive the implement base 250 and a latch assembly 230, discussed below. In some embodiments, the head portion 162 may be defined as a generally rounded member having a closed side and an open side. The open side includes a base wall or cavity floor 360 defining an interior bottom surface of the head portion 162 and an outer wall (e.g. head ring outer wall 192) extending outwards therefrom. In some embodiments, a faceplate shelf 370 extends from the outer wall 192 inwards towards a center of the head portion 162 and is positioned below a top end of the outer wall 192. The faceplate shelf 370 may include one or more structural ribs 372 that extend perpendicular to the faceplate shelf 370 and to the cavity floor 360 to provide additional rigidity to the faceplate shelf 370. The faceplate 194 includes an underside surface that may define one or more channel structures. (See FIG. 8A). The one or more channels may extend from the center of the faceplate 194, radially outward, toward the edge of the faceplate 194.

Multiple structures defining flow paths and receiving compartments may extend upwards from the cavity floor 360. For example, an inner ring 380 may extend upward from the cavity floor 360 spaced apart from the outer wall 192. The inner ring 380 may be flattened near the grip portion 160. A head cavity fluid path 384 (see arrows at base of head portion 162 in FIGS. 4 and 6) is defined, in part, by the outer wall 192, the inner ring 380, and the cavity floor 360. This fluid path 384 may traverse a perimeter of the head portion 162 to supply fluid to the nozzles 212.

The interior of the inner ring 380 defines a plurality of compartments/spaces separate from the fluid path 384. One space, within the head cavity is a retentioner compartment or cavity 392, a centrally located compartment in communication with the exterior of the cleansing device 102, and configured to accept a retention device 394 (e.g., the latch assembly 230). The retentioner compartment 392 may be generally defined by an inner surface 396 of the inner ring 380, and two parallel channel walls 398. Positioned between the channel walls 398 and the inner ring 380 may be a plurality of longitudinal ribs 400 connecting the channel walls 398 and the inner ring 380. The ribs 400 may provide support for the implement base 250. The retentioner compartment 392 may include one or more structures for positioning the retention device 394. In the embodiment shown in FIG. 4, the channel wall 398 includes a shoulder structure extending away from the channel wall 398 toward the center of the retentioner compartment 392. The shoulder structure defines a track for supporting the retention device 394. Also positioned within the retentioner compartment 392 is a post structure 410, extending upward from the cavity floor 360. This post structure 410 may be referred to as the latch pin post. The latch pin post 410 may define a rectangular structure, with front and back surfaces positioned perpendicular to the channel walls. The latch pin post 410 may be supported by one or more fins 412 extending from the front and/or back surface and contacting the cavity floor 360.

The grip portion 160 is typically sized to allow a user to comfortably grasp and manipulate the cleansing device 102. Additionally, the grip portion 160 may be sized and shaped to allow a user's fingers to extend around the grip portion 160, as well as to be aesthetically pleasing. The head portion 162 may be formed separately from the grip portion 160 and may be connected thereto, or the grip portion 160 and head portion 162 may be integrally formed. The head portion 162 may have a generally round shape and be configured to receive the brush assembly 132. That is, the head portion 162 is shaped to correspond to the size and shape of the cleansing implements 130 and may be varied accordingly. The shape of the cleansing device 102, including the head portion 162, grip portion 160, and handle cavity may be varied as desired based on various configurations of the cleansing device 102, brush assembly 132, etc.

Figure 7B:
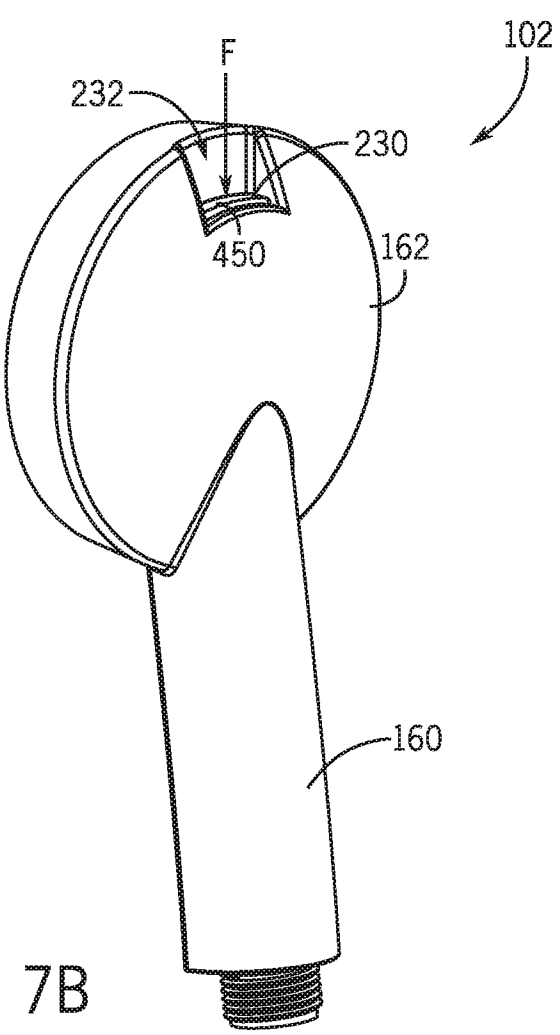
FIGS. 7A and 7B show the retention device positioned at the rear of the cleansing device in engaged and released positions, respectively.
Figure 7A:
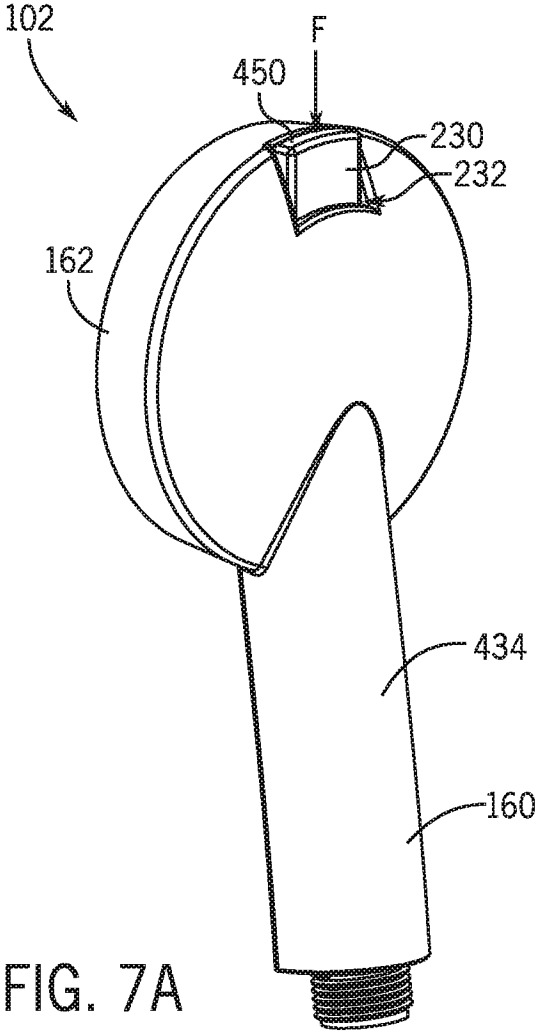

The grip portion 160 may include a top surface 430, side surfaces 432, and a bottom surface 434 (see FIGS. 7A and 7B). The top surface 430 of the grip portion 160, as shown in FIG. 2, may define a window 436. In these embodiments, the cleansing device 102 may optionally include a pause lever 440 positioned within the window 436. The pause lever 440, which in most embodiments may be depressed or re-positioned within the window 436 (see also FIG. 2), may be in mechanical communication with a pause valve (not shown) positioned within the interior of the cleansing device 102, below the window 436.

In FIG. 4 the retention device 394 of the cleansing device 102 is shown positioned between the underside of the faceplate 194 and the cavity floor 360 of the head cavity, and may be configured to extend out of the head cavity, as shown in FIG. 2. In this embodiment, the retention device 394 defines the latch assembly 230 shown in FIG. 2, and includes a latch body 446 having a first, contact end 450 and a second, retentioner end 452, and two side panels 454. The side panels 454, ends 450 and 452, and a latch floor 456 (visible in FIG. 5) may help to define an interior latch compartment containing a variety of structures. Positioned within this interior compartment may be a biasing element 468 and a retentioner 470. The biasing element 468 of FIG. 4 is a spring, and the retentioner 470, in this embodiment, includes a retentioner magnet 472, a retentioner housing 474, and a retentioner holder 476. As shown in FIG. 4, the biasing element 468, which may be referred to as a latch biasing element, may be positioned about a latch pin 480 that is fixedly attached, at a first end, to the latch body 446 at or near the contact end 450 of the latch body 446.

Figure 5:
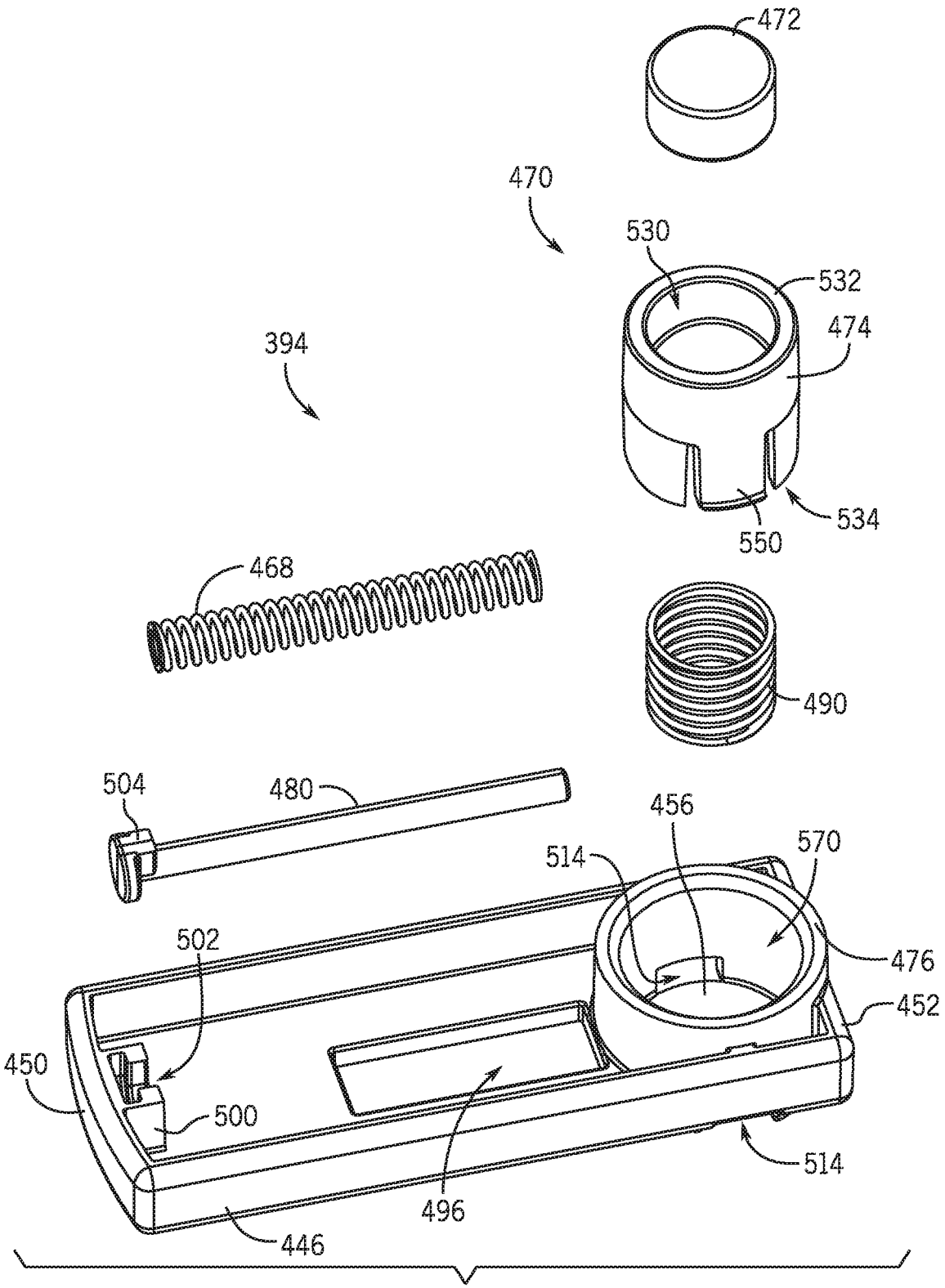
FIG. 5 is an exploded view of a retention device of FIG. 4.

The retention device 394 of FIG. 4 is shown in more detail in FIG. 5, which is an exploded view of the retention device 394. This view shows the latch body 446, the biasing element 468, the latch pin 480, the retentioner 470, the retentioner housing 474, retentioner holder 476, and a retentioner housing spring 490. The latch floor 456 includes a generally rectangular post window 496 defined therethrough. A pin securing structure 500 is positioned within the interior compartment of the latch body 446 at or near the contact end 450. For example, the pin securing structure 500 may extend inwards from an interior surface of the end sidewall of the latch body 446. The pin securing structure 500 defines a keyed receptacle 502 that is complementary to a keyed feature 504 at the first end, or head of the latch pin 480.

The retentioner holder 476 includes one or more tang windows 514 defined by the interior wall of the retentioner holder 476, and positioned at or near the base of the interior wall, near the latch floor 456. The tang window 514 may be positioned at or near the side panels 454.

A retentioner housing spring 490 supports the retentioner housing 474 and may be positioned between the retentioner housing 474 and the latch floor 456 of the retentioner holder 476.

The retentioner housing 474 supports the retentioner magnet 472 in the latch assembly 230. The retentioner housing 474 may include one or more cavities configured to accept a retentioner magnet 472 and/or a retentioner housing spring 490. In some embodiments, the retentioner housing 474 is a generally cylindrically shaped component having a magnet cavity 530 recessed below a top rim 532 of the retentioner housing 474 and a spring cavity 534 defined on a bottom side of the retentioner housing 474 and configured to allow partial insertion of the retentioner housing spring 490. Partial insertion may aid in allowing the spring 490 to exert a constant force on the retentioner housing 474 away from the latch floor 456. The retentioner housing 474 includes two or more tangs 550 positioned at or near the base of the retentioner housing 474. The tangs 550 of the retentioner housing 474 extend radially outward from the base of the retentioner housing 474 and are configured to engage the tang windows 514 of the retentioner holder 476.

The latch body 446, latch pin 480, biasing element 468, retentioner housing spring 490, retentioner housing 474, and retentioner 470 define the latch assembly 230. As show in FIG. 5, the magnet 472 is inserted into the holding or magnet cavity 530 of the retentioner housing 474, and the retentioner housing spring 490 inserted into the spring cavity 534. The retentioner housing 474, with magnet 472 and spring 490 in place, is then inserted into a retentioner cavity 570 of the retentioner holder 476 until the tangs 550 of the retentioner housing 474 engage the tang windows 514 of the retentioner holder 476 at or near the base of the retentioner cavity 570. The biasing element 468 is positioned about the latch pin 480.

Figure 6:
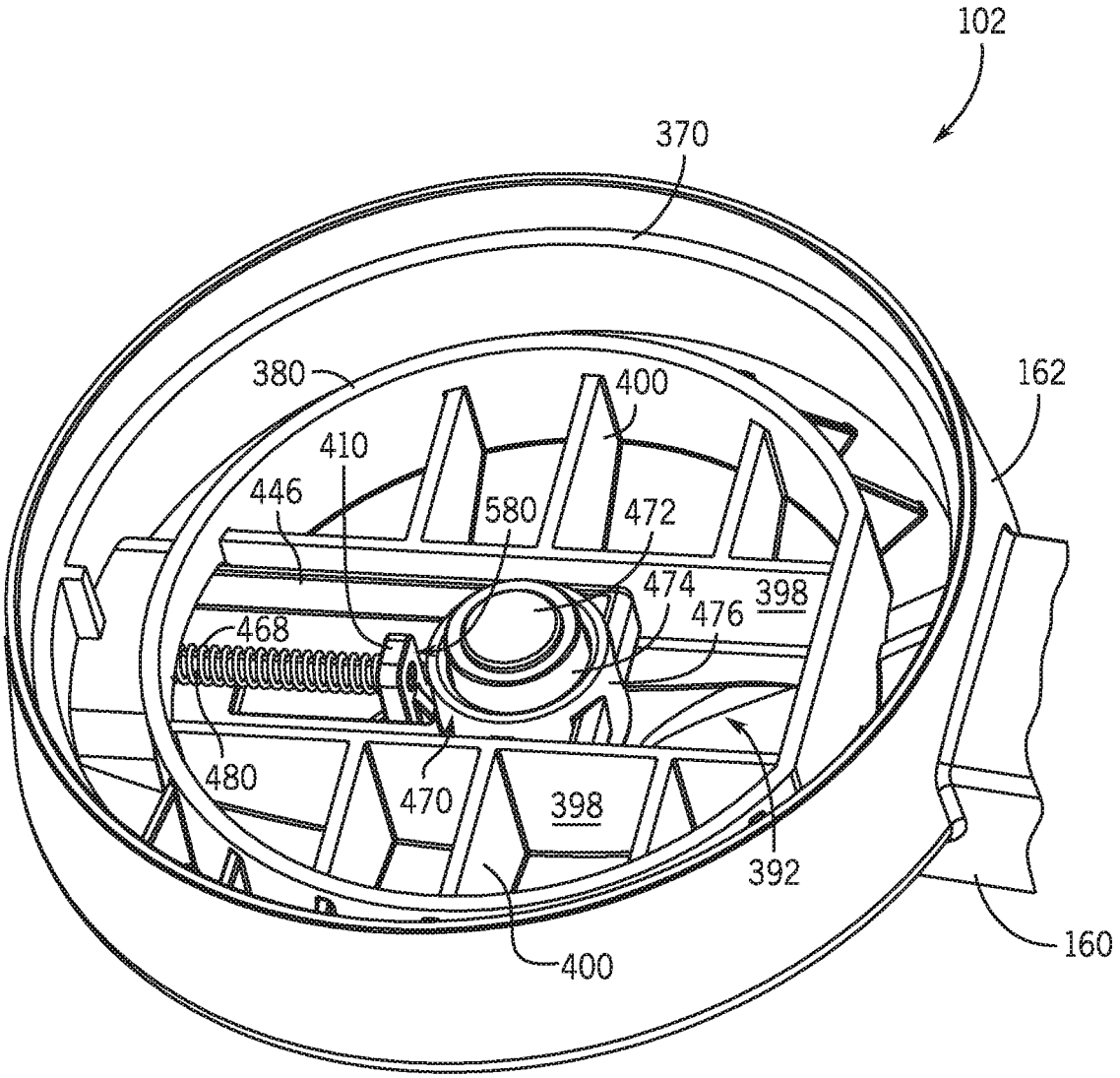
FIG. 6 shows the retention device positioned in the head of the cleansing device.

FIG. 6 shows the latch assembly 230 (with retentioner 470 in place), inserted into the retentioner compartment 392 of the head portion 162. The latch assembly 230 is positioned between the channel walls 398 and supported by the latch track on each channel wall 398. The latch assembly 230 is moveably secured to the cleansing device 102 by the latch pin's insertion into an eyelet 580 formed in the latch pin post 410 after which the head of the latch pin 480 may be inserted into the keyed receptacle 502 of the pin securing structure 500. The biasing element 468 is configured to press against the latch pin post 410 when the latch pin 480 is inserted deeper or through the eyelet 580.

To assemble the cleansing device 102, the latch assembly 230 is inserted into the latch channel of the head portion 162. The latch pin post 410 extends upward through the post window 496 of the latch assembly 230. The biasing element 468 or spring is positioned about the latch pin 480, which is then partially inserted into the latch pin post 410 at the eyelet 580, and the keyed feature 504 of the latch pin 480 inserted in the keyed receptacle 502 of the pin securing structure 500 in the inner wall of the latch assembly 230. Where the cleansing device 102 includes a pause lever 440, a pause valve may be positioned within the interior of the grip portion 160 near, and mechanically connected to, the pause lever 440, which extends upward from the interior through the pause lever window 436 in the exterior surface of the grip portion 160. The head cavity insert is inserted into the head cavity and the faceplate 194 is inserted into the head portion 162. Insertion of the faceplate 194 completes the head cavity space and the retentioner cavity space. Insertion of the faceplate 194 may also result in creating a plurality of spaces, retentioner compartments 392, defined by the wall of the inner ring 380, one or more support ribs 400, an outer wall of the channel, and the underside of the faceplate 194. The embodiment of FIG. 6 includes eight compartments within the inner ring 380, and one retentioner compartment 392. The underside of the faceplate 194 creates a fluid seal with a rim of the inner ring 380 to aid in fluidly separating the head cavity, which is in fluid communication with a water source, and the retentioner compartment 392, which is in communication with the exterior of the cleansing device 102. With the faceplate 194 in place in the head portion 162 of the cleansing device 102, the cleansing implement 130 may be inserted into the interface cavity 354 to create the cleansing device 102.

The cleansing implement 130 is held securely in the implement cavity 206 of the cleansing device 102, and can be quickly and easily removed/replaced. In many embodiments, displacement of the latch assembly 230 may be accomplished manually, by the user exerting a force against the latch assembly 230. In the engaged position, the latch assembly 230 is in a first state and in a first position such that the retentioner magnet 472 of the latch assembly 230 is positioned below or otherwise aligned with the magnet 294 in the cleansing implement 130. This allows the magnetic force to couple the cleansing implement 130 to the faceplate 194. In this first position, as shown in FIGS. 7A (and 8A), a portion of the latch body 446 extends partially through the latch window 232 of the cleansing device 102, such that the latch body 446 is visible outside the head portion 162 and accessible to the user.

Figure 8A:
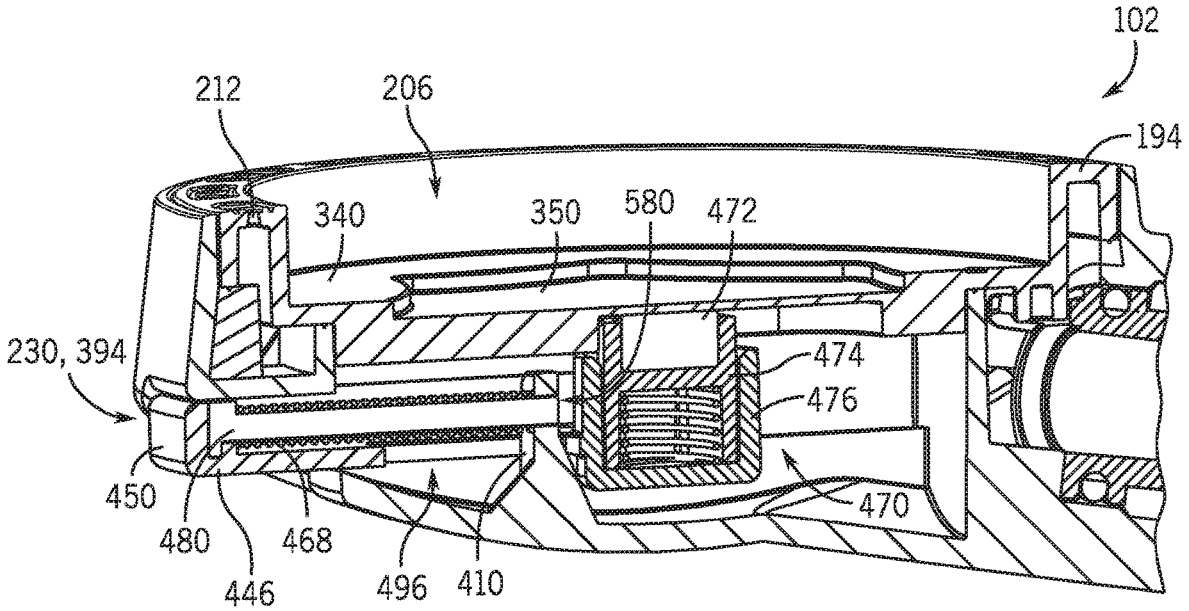
FIGS. 8A and 8B show sectional views of the cleansing device in engaged and released positions, respectively.

In the engaged position and with reference to FIG. 8A, the biasing element 468 is in a relaxed, uncompressed state, and the latch pin 480 is partially inserted through the eyelet 580 defined through the latch pin post 410. The retentioner magnet 472 of the latch assembly 230 is positioned at or near the center of the implement cavity 206, below the interface surface 350. The retentioner magnet 472 is positioned at a first end of the channel defined on the bottom surface of the faceplate 194 and the retentioner housing spring 490 biases the retentioner housing 474 upwards to ensure that the retentioner magnet 472 engages the bottom surface of the channel to reduce the separation distance between the magnet 472 and the implement carrier 112 (when connected). This helps to ensure that the magnetic force will be as strong as possible between the two magnets.

Figure 8B:
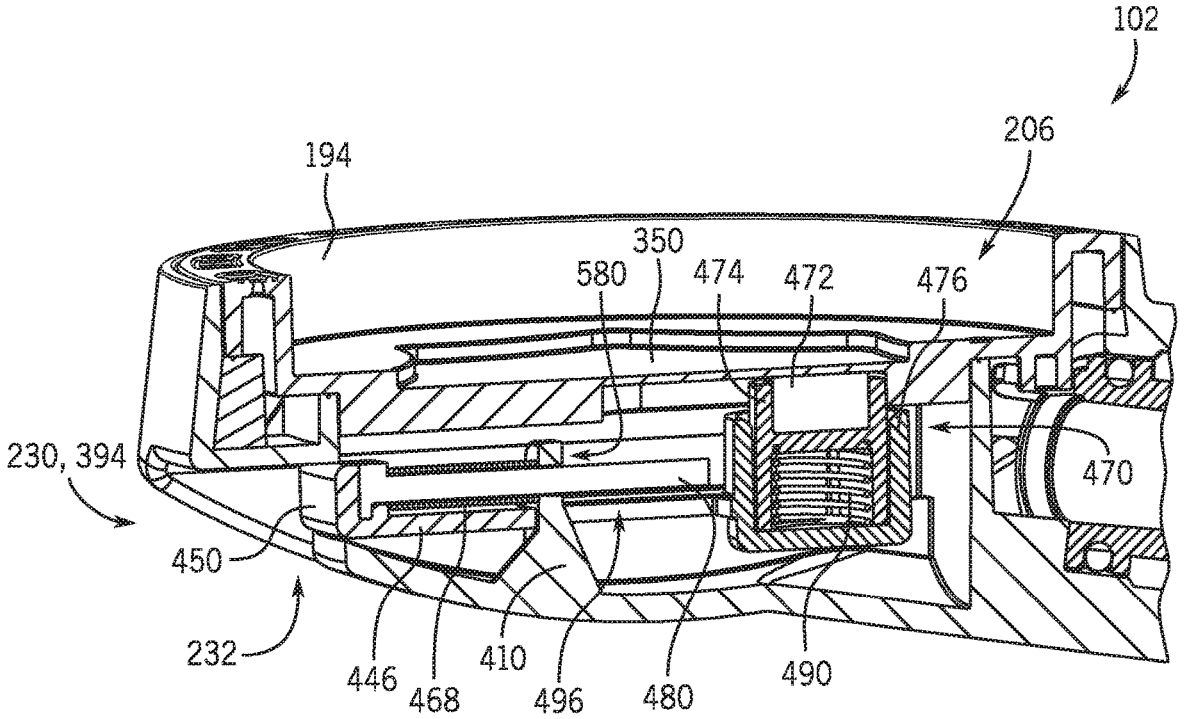

To disengage the latch assembly 230, a user presses against the outer exposed surface of the latch body 446. This overcomes the biasing force exerted by the biasing element 468, and causes the latch body 446 to move through the latch window 232 into the track channel towards the inlet of the head portion 162 (e.g., radially inwards towards the grip portion 160). With reference to FIG. 8B, the latch assembly 230 may be displaced until the latch body 446 is positioned substantially within the head portion 162, with substantially only a portion of the contact end 450 of the latch assembly 230 being visible. As the latch body 446 moves, the biasing element 468 compresses against the latch pin post 410 within the head portion 162. Additionally, the retentioner magnet 472 moves along with the latch body 446 radially inwards and slides along the bottom surface of the faceplate 194 within the channel towards a second end of the channel. In this position, the retentioner magnet 472 is offset from a central region of the faceplate 194 and outside of an engagement zone (i.e., misaligned) from where the engagement device 292 of the cleansing implement 130 would be positioned. As such, the magnetic attraction between the retentioner magnet 472 and the magnet 294 of the cleansing implement 130 may be sufficiently reduced to allow a user to remove the cleansing implement 130. This may be referred to as the "Released" position, because the retentioner magnet 472 of the latch assembly 230 is no longer positioned below the position of the magnet 294 of the cleansing implement 130.

When the user force is removed from the latch body 446, such as when a user removes his or her finger, the compressed biasing element 468 of the latch assembly 230 releases, exerting a force on the latch body 446, causing the latch body 446 to return to the engaged position. In particular, the latch body 446 and the retentioner magnet 472 move laterally within the head portion 162 towards the latch window 232 with a portion of the latch body 446 extending outside of the latch window 232.

A user may remove a cleansing implement 130 from the storage device and secure it into the head portion 162 of the cleansing device 102 before allowing water to flow through the cleansing device 102. In some cases, a user may pause water flow through the cleansing device 102, by engagement of the pause lever 440, prior to placing an cleansing implement 130 into the head portion 162. Water may flow through the system from the J-pipe 146, by first flowing through diverter 106 and into the connector hose 108. The water may then flow from the connector hose 108 to the handle body 170 of the cleansing device 102, exiting the cleansing device 102 at the nozzles 212 positioned around the cleansing implement 130. Pressing the cleansing implement 130 against the users skin may help to cleanse/exfoliate skin, while the water from the nozzles 212 hitting the skin may help dislodge cells, dirt, debris, etc. from the skin and carry it away. The cleansing implement 130 doesn't turn, secured in place by the latch assembly 230 and the engagement features. This provides a stronger brushing effect than rotating brushes because the bristles 252 do not rotate when contacted with the skin, causing the skin to flex, removing debris and/or cells. In many embodiments, water may flow through the J-pipe 146 into the cleansing system 100, but entering first the diverter 106. From the diverter 106, water may flow through the showerhead 104 and/or the connector hose 108. Water may flow from the connector hose 108 into the interior of the elongated grip portion 160, where it may flow through a pause valve, if such valve is in an 'open' position. The water may then flow from the cleansing device 102. In most embodiments, as depicted in FIGS. 4, and 6, the flow path may bifurcate such that a portion flows into the head cavity in a counter-clockwise direction and another portion flows in a clockwise direction. In other embodiments, the water may flow only in a clockwise or counter-clockwise direction. The water may then exit the head cavity through the nozzles 212.

Figure 9A:
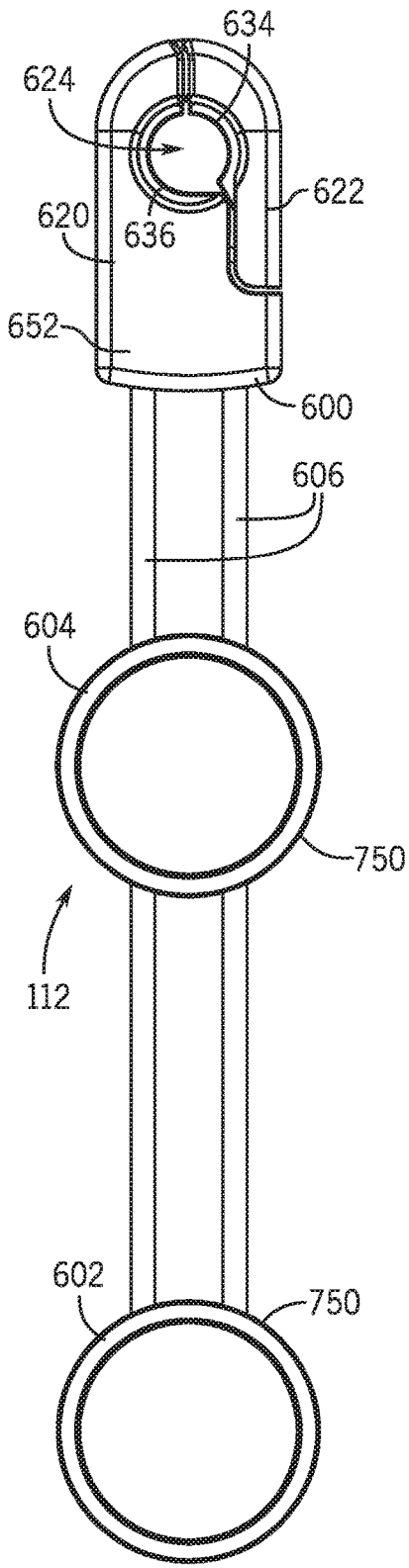
FIGS. 9A-9E show various views of the implement carrier of FIG. 1.
Figure 9B:
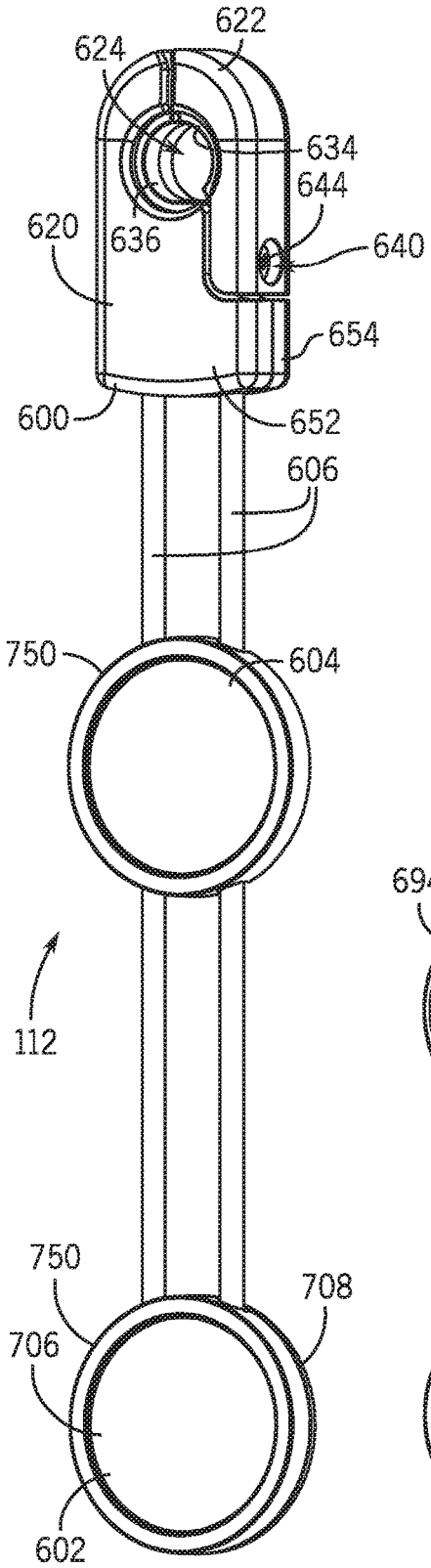
Figure 9C:
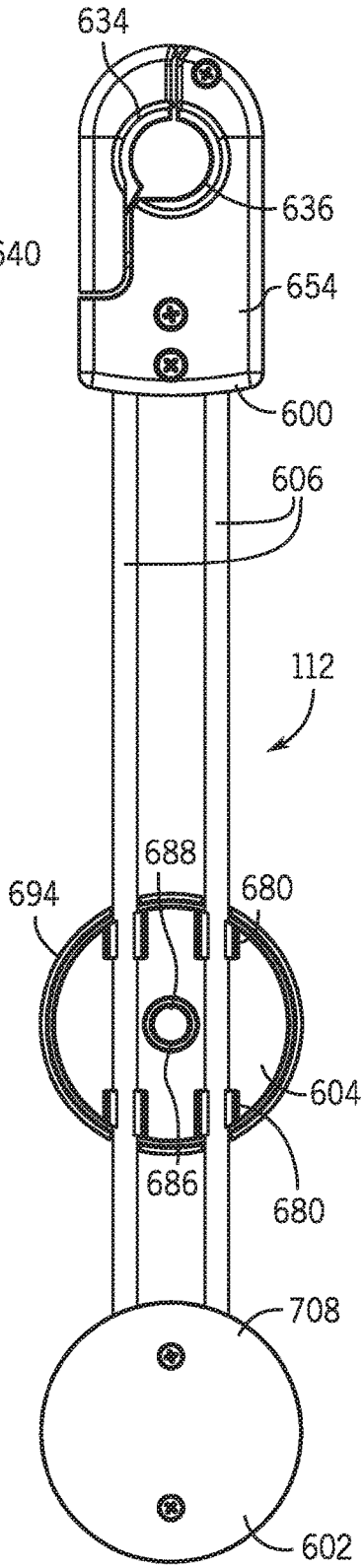
Figure 9D:
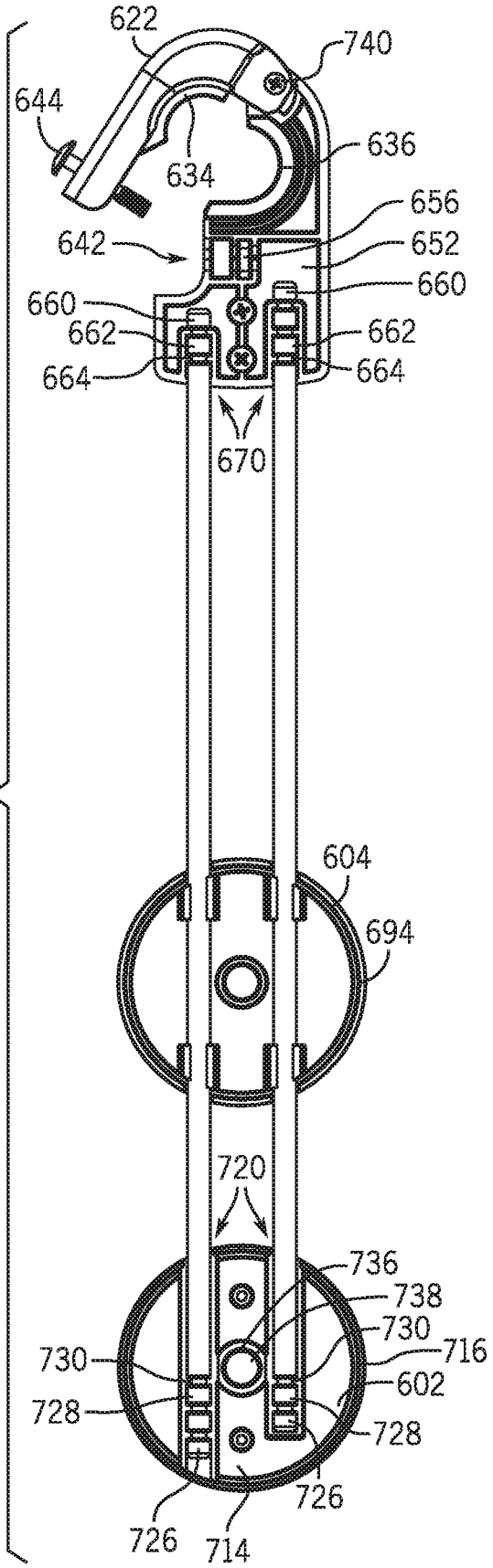
Figure 9E:
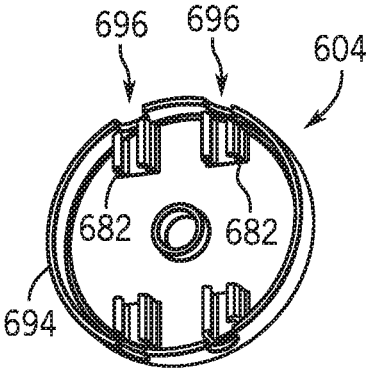

As shown in FIG. 1, the cleansing system 100 optionally includes an implement carrier 112. The implement carrier 112 is shown in multiple views in FIGS. 9A-9C. FIG. 9A is a front view of one embodiment of the implement carrier 112. FIG. 9B is a front perspective view of the embodiment shown in FIG. 9A. FIGS. 9C and 9D are rear views of the embodiment shown in FIGS. 9A and 9B. The generally elongate implement carrier embodiment shown here comprises a hanger structure 600 at one end, a stationary implement holder 602 at the other end, and a second, moveable implement holder 604 and a plurality of rails 606 positioned between the hanger structure 600 and the stationary implement holder 602. The embodiment of FIG. 9 includes one stationary implement holder 602 and one movable implement holder 604 that can be re-positioned along the rails 606. Other embodiments may include additional or fewer implement holders 140, as well as multiple moveable implement holders 604.

The hanger structure 600 of the carrier comprises a hanger body 620 and a hinge 622 (as shown in FIG. 9D) that, together, may define a pipe aperture 624 or otherwise is configured to be received around a J-pipe 146. Fixedly attached to the hinge 622, and positioned adjacent the aperture 624 is a bumper structure 634 that extends from the hinge 622 radially inward. A similar bumper structure 636 is fixedly attached to the hanger body 620, adjacent the aperture 624. The hinge 622 may further include a hinge channel 640 (FIG. 9B) extending through the hinge 622. One end of the hinge channel 640 may be adjacent a hanger channel 642 in the hanger body 620. The hinge channel 640 and hanger channel 642 are configured to receive a securing structure 644. The securing structure 644, which may be referred to as a hinge securing screw, may aid in fixedly mating the hinge 622 to the hanger body 620.

The hanger body 620 may define an outer surface and an inner surface. The outer surface of the hanger body 620 may comprise one or two shells. The hanger body 620 embodiment shown in FIG. 9A-9D is comprised of two shells, a front shell 652 and a rear shell 654. In FIG. 9D, the rear shell 654 is removed and the interior of the hanger body 620 is visible. Positioned within the interior of the hanger body 620 is a nut 656 or other structure for accepting and holding the securing structure 644, which may be a screw or similar device.

The ends of the rails 606 are inserted into the interior of the hanger body 620 (see FIG. 9D). The rails 606 end in a post structure 660, having a circumference that is generally smaller than the circumference of the rail 606 outside the hanger body 620. The rails 606 may also include one or more knobs 662 distal to the post. The knobs 662 have a circumference that is generally similar to the circumference of the rails 606 outside the hanger body 620. The knobs 662 are separated from the remainder of the rail 606 and each other by a constriction 664. The constriction 664 has a circumference that is generally less than that of the post 660. The interior of the hanger body 620 may define one or more rail receiving channels 670 configured to engage the post 660, knobs 662, and constrictions 664 to secure the rails 606.

FIGS. 9A and 9B show the front side of the movable implement holder 604, while FIGS. 9C and 9D show the rear side. A plurality of rail tabs 680 are positioned on the back side of the movable implement holder 604 to aid in moveably engaging the rails 606. Each tab 680 comprises two deformable tongs 682. The tongs 682 extend outward from the back side of the movable implement holder 604 to a height that is greater than the diameter of the rail 606. In most embodiments, each tong 682 may define a semicircular face positioned toward the interior of the tab 680. This semicircular face may aid in holding a rail structure that is generally tubular. The movable implement holder 604 may further include a retentioner holder 686 extending away from the back side of the movable implement holder 604 and positioned at or near the center. The retentioner holder 686 is configure to accept a retentioner device 688. In this embodiment, the retentioner device 688 is a magnet. The movable implement holder 604 may also include an apron 694 extending outward from the back side of the movable implement holder 604 at or near the implement holder's edge. The apron may define at least two rail channels 696 for each rail 606 passing behind the movable implement holder 604. The rail channel 696 defines the same general shape of that of the rail 606. The channels 696 may allow the rail 606 to be positioned closer to the back side of the movable implement holder 604, thereby limiting the height necessary for the tongs 682 to extend beyond the rail 606.

The stationary implement holder 602 is positioned at the ends of the rails 606 distal the hanger body 620. The embodiment of the stationary implement holder 602 shown in FIGS. 9A-9D comprises a front shell 706 and a rear cover 708. The front shell 706 has a front surface 712 and a back surface 714, and an apron 716 extending away from the back surface 714 at the edge of the implement holder 602. The back surface 714 of the front shell 706 and the rear cover 708 define a holder interior cavity. The ends of the rails 606 are held securely within this holder interior cavity by rail receiving channels 720 similar to those in the hanger body 620. The ends of the rails 606 within the holder interior cavity include posts 726, knobs 728, and constrictions 730 that are held securely by complementary structures in the rail receiving channels 720. The stationary implement holder 602, like the movable implement holder 604, may also include a retentioner holder 736 extending away from the back surface 714 of the front shell 706. This retentioner holder 736 is also positioned at or near the center of the implement holder 602, between the rails 606, and configured to accept a retentioner device 738, for example a magnet. The apron 716 of the stationary implement holder 602 defines at least one rail apron channel for each rail 606 inserted into the holder interior cavity.

The rails 606 are inserted into rail receiving channels 720 in the front shell 706 of the stationary implement holder 602 and the front shell 652 of the hanger body 620, the retentioner device 738 placed into the retentioner holder 736, and then the rear cover 708 of the stationary implement holder 602 is applied and fixed in place by one or two screws. The hinge 622 is positioned adjacent the hanger body 620 so that a pivot screw channel of the hinge 622 is aligned with a pivot screw channel of the hanger body 620. The bumper structures 634 and 636 are placed at the perimeter of the aperture 624 and the rear shell 654 applied and securely held by one or more body screws. A pivot screw 740 is inserted through the pivot screw channels and secured by a receiving structure in the front shell 652 of the hanger body 620.

The hinge 622 may be opened to allow a J-pipe 146 to be inserted through the aperture 624. The hinge 622 is then moved to bring a securing end in proximity to the hanger body 620. The hinge securing screw 644 is inserted into the hanger channel to contact the nut 656. Rotating the screw 644 may fixedly secure the hinge 622 to the hanger body 620.

A movable implement holder 604 may be clamped on to the rails 606 and held securely by the tongs 682 in the backside of the movable implement holder 604. The user may apply a force to moveable implement holder 604 to allow the holder 604 to slide toward the stationary implement holder 602 or the hanger body 620, with the rails 606 passing through the channels 696 and the tongs 682 applying sufficient friction to allow the moveable implement holder 604 to move without detaching from the rails 606. Additional holders 604 may be added by positioning the rails 606 adjacent the channels 696 and applying sufficient force to the holder 604 to deform the tongs 682 and reposition the rails 606 between a tong pair.

In many embodiments, a cleansing implement 130 may be positioned with its lower, engagement surface 268 proximal the front side of either the moveable 604 or stationary implement holder 602 until the engagement device 292 of the cleansing implement 130 is sufficiently near the retentioner device 688 to affect engagement. In most embodiments, the implement holders 140 of the implement carrier 112 define a rim structure 750 extending outward from the front surface to define a depth that is less than a depth of the implement cavity 206 of the cleansing device 102. This difference in depth may aid in allowing the user to grasp the cleansing implement 130 and remove the cleansing implement 130 from the implement holder 140 with sufficient force to counteract an attraction between retentioner devices 688, 738 and engagement device 292.

It should be noted that any of the features in the various examples and embodiments provided herein may be interchangeable and/or replaceable with any other example or embodiment. As such, the discussion of any component or element with respect to a particular example or embodiment is meant as illustrative only.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components that terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A cleansing system comprising:

a cleansing device comprising:

an elongated handle; and a head portion extending from an end of the handle and including a plurality of nozzles positioned around a perimeter of the head portion, the head portion defining an annular fluid path in fluid communication with the plurality of nozzles to supply fluid to the nozzles and including a first magnetic material positioned radially inward of the annular fluid path; and a cleansing implement magnetically coupled to the head portion of the cleansing device, the cleansing implement including a second magnetic material that is magnetically attracted to the first magnetic material to couple the cleansing implement to the head portion of the cleansing device;

wherein the first magnetic material is movably positioned within the head portion to facilitate removal of the cleansing implement from the head portion.

2. The cleansing system of claim 1, wherein the first magnetic material comprises a magnet.

3. The cleansing system of claim 1, wherein the second magnetic material comprises a magnet or a ferric material.

4. The cleansing system of claim 1, wherein the cleansing implement is non-rotatably coupled to the head portion.

5. The cleansing system of claim 1, wherein the cleansing implement comprises a brush assembly or a pumice assembly.

6. The cleansing system of claim 1, wherein the cleansing implement comprises an implement base that includes the second magnetic material.

7. The cleansing system of claim 6, wherein:

the head portion defines an implement cavity; and the implement base is seated in the implement cavity.

8. The cleansing system of claim 7, wherein:

the first magnetic material is positioned adjacent to the implement cavity; and the second magnetic material is received in the implement cavity.

9. The cleansing system of claim 8, wherein the head portion includes a wall at least partially defining the implement cavity and separating the first magnetic material from the second magnetic material.

10. The cleansing system of claim 1, wherein the head portion includes an outer wall and an inner ring that at least partially define the annular fluid path.

11. The cleansing system of claim 1, wherein the first magnetic material is movable between a first position in which the first magnetic material is aligned with the second magnetic material and a second position in which the first magnetic material is misaligned with the second magnetic material.

12. The cleansing system of claim 11, wherein the first magnetic material is biased toward the first position.

13. The cleansing system of claim 11, wherein the first magnetic material moves laterally within the head portion to move between the first position and the second position.

14. The cleansing system of claim 1, wherein the handle includes a pause lever for controlling the amount of fluid supplied to the plurality of nozzles.

15. The cleansing system of claim 1, further comprising:

a diverter configured for connection to a water source and including a first outlet and a second outlet;

a showerhead fluidly connected to the first outlet of the diverter; and the cleansing device of claim 1 fluidly connected to the second outlet of the diverter.

16. The cleansing system of claim 15, further comprising a bracket connected to the diverter and configured to engage a water connection end of the handle of the cleansing device at a position below the diverter.

17. The cleansing system of claim 15, further comprising an implement holder, wherein the cleansing implement is magnetically coupled to the implement holder via the second magnetic material.

18. The cleansing system of claim 17, wherein the implement holder is movably coupled to a rail such that the implement holder is repositionable along a length of the rail.

19. A cleansing system comprising:

a cleansing device comprising:

an elongated handle; and a head portion extending from an end of the handle and including a plurality of nozzles positioned around a perimeter of the head portion, the head portion defining an annular fluid path in fluid communication with the plurality of nozzles to supply fluid to the nozzles and including a first magnetic material positioned radially inward of the annular fluid path;

a cleansing implement magnetically coupled to the head portion of the cleansing device, the cleansing implement including a second magnetic material that is magnetically attracted to the first magnetic material to couple the cleansing implement to the head portion of the cleansing device;

a diverter configured for connection to a water source and including a first outlet and a second outlet, the cleansing device fluidly connected to the second outlet of the diverter;

a showerhead fluidly connected to the first outlet of the diverter; and an implement holder, wherein the cleansing implement is magnetically coupled to the implement holder via the second magnetic material.

20. The cleansing system of claim 19, wherein the implement holder is movably coupled to a rail such that the implement holder is repositionable along a length of the rail.

* * * * *